United States Patent [19]

Conrad

[11] Patent Number: 5,058,349

[45] Date of Patent: Oct. 22, 1991

[54] SURFACE TILE FOR FLOORING AND THE LIKE

[76] Inventor: Michael J. Conrad, 4747 Farnsworth Rd., Marion, N.Y. 14505

[21] Appl. No.: 495,403

[22] Filed: Mar. 19, 1990

[51] Int. Cl.[5] ..... E04F 13/08

[52] U.S. Cl. ..... 52/392; 52/578; 52/581

[58] Field of Search ..... 52/392, 589, 593, 603, 52/480, 592, 408, 312, 747, 745, 578, 645; 403/364, 381

[56] References Cited

U.S. PATENT DOCUMENTS

| | | | |
|---|---|---|---|
| 1,124,228 | 1/1915 | Houston | 403/381 |
| 1,444,611 | 2/1923 | Johansson | 52/578 |
| 4,462,712 | 7/1984 | Penland, Sr. | 52/581 X |
| 4,600,336 | 7/1986 | Waller, Jr. | 52/581 X |

*Primary Examiner*—David A. Scherbel
*Assistant Examiner*—Creighton Smith
*Attorney, Agent, or Firm*—Robert J. Bird

[57] ABSTRACT

A system of surface tiles for flooring or the like, and the method of their installation. The tiles each include a backing board, a number of spaced parallel stationary slats fixed on the backing board, and a longitudinally movable slat in each space between successive stationary slats and dovetailed between them. The movable slats are movable to stagger their ends relative to the ends of the stationary slats, and to extend from one tile to the next to interlock the tiles. Tiles are installed by: a. placing a number of tiles in a longitudinal row; b. moving the movable slats of a single working tile to desired staggered positions relative to the stationary slats; c. cutting the working tile transversely into tow end pieces; d. placing one of the end pieces on one end of the row with its cut edge outward of the row; e. moving the movable slats of the row to fill empty spaces between stationary slats; and f. placing the other of the end pieces on the other end of the row with its cut edge also outward of the row.

7 Claims, 1 Drawing Sheet

SURFACE TILE FOR FLOORING AND THE LIKE

FIELD OF THE INVENTION

This invention relates generally to surface tiles for floors or other surfaces, and more specifically to surface tiles with multiple slats, alternately stationary and movable, for staggering the ends of adjacent slats.

The invention is expected to find its primary use for flooring, and it will be described in that context. The method and apparatus described are also applicable to other surfaces, such as wall, ceiling, and roof surfaces.

BACKGROUND INFORMATION

Two types of hardwood floors are in general use. One is assembled of many individual floor boards laid side by side and individually nailed or glued to a subfloor. The floor boards are placed so that abutting ends of individual boards are randomly arrayed throughout the floor area, rather than aligned. This type of hardwood floor is in widespread use. It is a desirable floor, but its installation is relatively labor intensive.

The other type is a tiled floor, an assembly of square or rectangular slatted floor tiles, each tile consisting of a number of slats glued together or locked to each other by a keying arrangement. This floor is assembled square by square, and the result it a discernible pattern of square or rectangular tiles. Floor tiles are manufactured by mechanized processes, and their installation is less labor intensive than that of individual floor boards.

It is an object of this invention to provide a system of floor or surface tiles with the aesthetic appearance of randomly positioned slat ends;

Another object is to provide a system of tiles with interengaging slats for improved structural strength and integrity.

Another object is a system of tiles which provides positive assurance of tile alignment and it therefore assembled with relative ease and economy.

Another object is a system of tiles which is assembled with less labor per unit area than required by the individual floor boards of the prior art.

SUMMARY OF THE INVENTION

In summary, the present invention is a system of surface tiles for flooring or the like, and the method of their installation. The tiles each include a backing board, a number of spaced parallel stationary slats fixed on the backing board, and a longitudinally movable slat in each space between successive stationary slats and dovetailed between them. The movable slats are movable to stagger their ends relative to the ends of the stationary slats, and to extend from one tile to the next to interengage the tiles. Tiles are installed by: a. placing a number of tiles in a longitudinal row; b. moving the movable slats of a single working tile to desired staggered positions relative to the stationary slats; c. cutting the working tile transversely into two end pieces; d. placing one of the end pieces on one end of the row with its cut edge outward of the row; e. moving the movable slats of the row to fill empty spaces between stationary slats; and f. placing the other of the end pieces on the other end of the row with its cut edge also outward of the row.

DRAWING

DESCRIPTION

Figure 1:
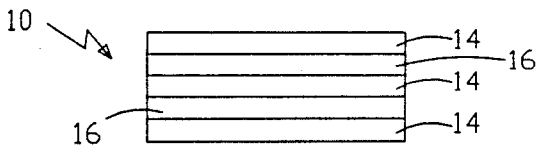
FIG. 1 is a top plan view of a surface tile or floor tile of this invention.
Figure 2:
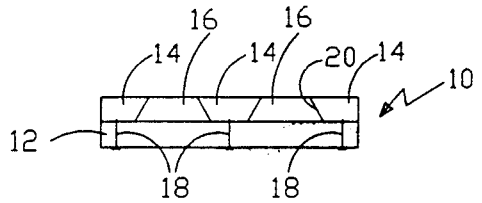
FIG. 2 is an enlarged end view of the right end of FIG. 1.
Figure 3:
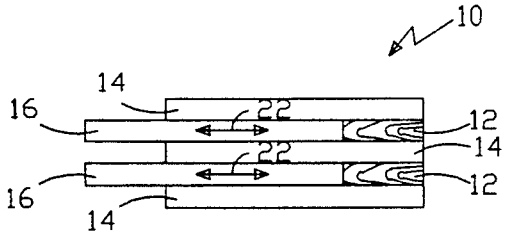
FIG. 3 shows a tile with movable slats extended equally.
Figure 4:
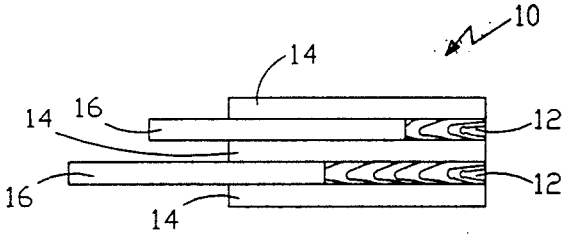
FIG. 4 shows a tile with movable slats extended by different amounts.

FIGS. 1 and 2 are respectively top and end views of a floor tile 10. Each tile 10 includes a backing board 12, a number of stationary floor slats 14 fixed to the backing board 12, and a number of movable floor slats 16 alternating with the stationary slats 14. The stationary slats 14 are fastened to the backing board 12 by glue or by nails or other mechanical fasteners 18 applied through the underside of the backing board. The movable slates 16 are held down on the backing board 12 by dovetails 20 or equivalent means of engagement with the stationary slats 14, such as a tongue and groove combination. Slats 16 are longitudinally slidable on the backing board relative to the stationary slats 14. FIGS. 3 and 4 show the tile 10 with its movable slats 16 extended equally and by different amounts, respectively. Arrows 22 indicate direction and movability of the slats 16. Those portions of the underlying backing board 12 exposed by the displacement of the slats 16 are contrasted with the slats 14 and 16 by cross hatching or shading.

The method of this invention will now be described with particular reference to FIGS. 5, 6, and 7. For tile installation, the room dimensions and tile orientation are first determined. The number of whole tiles required in each row of tiles depends on the "length" of the room, i.e. that dimension which corresponds to the longitudinal direction of the tile slats. Tiles 10 are placed end to end in a single row to span the approximate length of the room, and fixed in place. It is unlikely that a discrete number of tiles will just extend from wall to wall. There will usually remain a space to be filled by a partial tile. FIG. 6 represents the general condition, a row of whole tiles 10, set in place but extending short of the left wall 30 by a distance $X_a$ or short of the right wall 32 by a distance $X_c$ or both.

Figure 5:
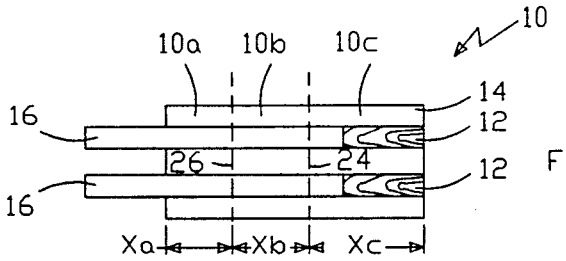
FIG. 5 shows a tile with movable slats extended and a transverse cutting line indicated across the tile.
Figure 6:
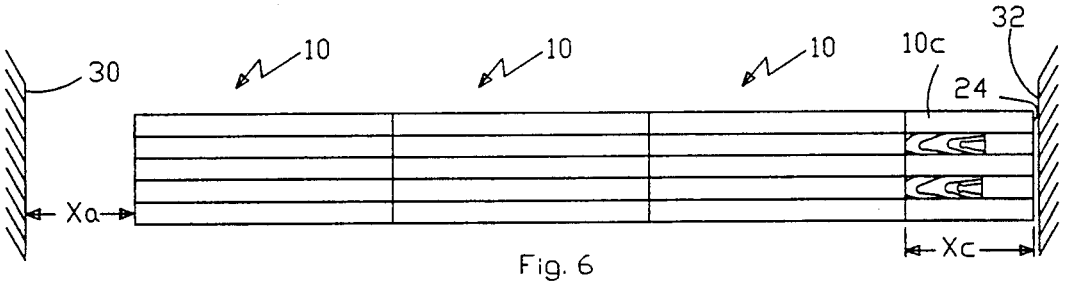
FIG. 6 shows a row of tiles placed in position for assembly.

A single "working" tile 10 is used for this purpose, a shown in FIG. 5. The length of the working tile is the sum of its partial lengths $X_a$, $X_b$, and $X_c$. The movable slats 16 of the working tile 10 are first extended for the desired staggered effect. A cut line 24 is placed at distance $X_c$ from the right end of the tile. The working tile 10 is cut along line 24, providing a right end piece **10*c* to fit between the right end of the row in FIG. 6 and the right wall 32. This cut end piece 10*c* from FIG. 5 is now rotated 180° and placed at the right end of the row of tiles 10 in FIG. 6 so that the cut edge likely to be relatively rough, it is best positioned at the ends and against thE wall where it can be covered with molding. The working tile 10 is then cut along line 26, providing a left end piece 10*a* to fit between the left end of the row in FIG. 6 and the left wall 30. This cut end piece 10*a* from FIG. 5 is also rotated 180° for placement at the left end of the row of tiles 10 in FIG. 6 with the cut edge 26 outward and against the wall 30. The remaining central portion 10***b* of the working tile 10 may be waste, or it may be a partial piece usable in another row of tiles to reduce waste.

Figure 7:
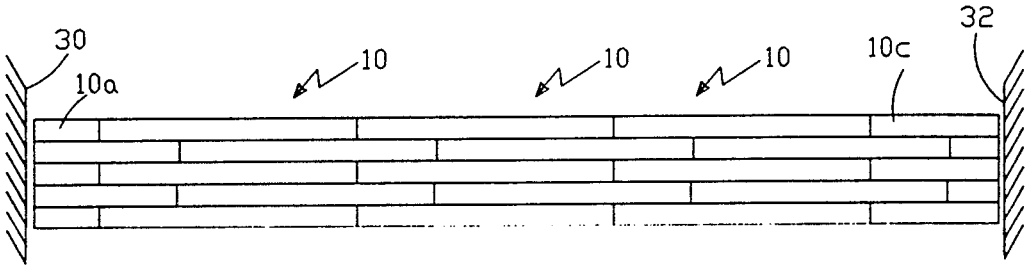
FIG. 7 shows the same row of tiles, with movable slats extended into their assembled and interengaged.

FIG. 7 shows the same row of tiles as in FIG. 6. Here, the movable slats 16 in the entire row are moved longitudinally to the right. The empty slat spaces shown near the right end of FIG. 6 are now filled in FIG. 7. The right end of the row of tiles is now assembled with the several slats in their desired staggered and interengaged positions. The other end of the row will be completed in the same manner, either with some or all of the end piece 10*b*, or from another end piece cut from another tile 10.

This simple procedure is repeated for each row until the floor is completely covered. Although the flooring tiles, as manufactured, may have some finish, additional surfacing can easily be applied to add to the finish and to the bond between slats.

The completed floor provides the aesthetic appearance of randomly positioned ends of the flooring slats. The interengaged or interdigitated slats throughout the extended area of the floor also add strength and structural integrity to the floor and therefore to the room and to the building.

Movable slats as described are presently preferred, but it is contemplated and within the scope of this invention to provide tiles having slats which are not movable but which are in a permanent offset configuration such as the configurations of FIGS. 3 and 4.

In the examples illustrates, the tiles 10 all include three stationary slats 14 and two movable slats 16. Many other combinations of stationary and movable slats might be used. The tiles are illustrated as approximately twice as long as they are wide. The illustrated dovetails are presently preferred for their simplicity, effectiveness and economy, but other equivalent expedients for interengaging the slats are well known. All such details of the movable foregoing description are only illustrative. The concept and scope of the invention are limited only by the following claims and equivalents thereof.

What is claimed is:

1. A tile for flooring or the like, including a backing board, a spaced plurality of parallel stationary slats fixed to said backing board, and a longitudinally movable slat in each space between successive stationary slats;

each said movable slat being in engagement with the stationary slats on each side thereof to restrain said movable slat in place on said backing board;

said movable slats being movable to stagger the ends thereof relative to the ends of said stationary slats, and to extend from one tile to the next to interengage said tiles.

2. A tile as defined in claim 1, in which said movable slats are dovetailed between said stationary slats.

3. A system of surface tiles for flooring or the like including a plurality of tiles each including a backing board, a spaced plurality of parallel stationary slats fixed to said backing board, and a longitudinally movable slat in each space between successive stationary slats;

said movable slats being movable to stagger the ends thereof relative to the ends of said stationary slats, and to extend from one tile to the next to interengage said tiles.

4. A system of surface tiles as defined in claim 3, in which each said movable slat is in engagement with the stationary slats one each side thereof to restrain said movable slat in place on said backing board.

5. A method of installing a system of surface tiles each including a backing board, a spaced plurality of parallel stationary slats fixed to said backing board, and a longitudinally movable slat in each space between successive stationary slats to stagger the ends thereof relative to the ends of said stationary slats and to extend from one tile to the next to interengage said tiles, including the following steps:

a. placing a plurality of said tiles in a longitudinal row;

b. of a single working tile, moving the movable slats thereof longitudinally to desired staggered positions relative to the stationary slats thereof;

c. cutting said working tile transversely into two end pieces;

d. placing one of said end pieces on one end of said row with the cut edge thereof outward of said row; and e. moving the movable slats of said row longitudinally to fill empty spaces between stationary slats.

6. The method as defined in claim 5, further including the following steps:

f. placing the other of said end piece on the other end of said row with the cut edge thereof outward of said row.

7. A system of surface tiles for flooring or the like including a plurality of tiles each including a backing board and a plurality of parallel mutually dovetailed slats fixed thereto, some of said slats being longitudinally offset relative to others of said slats to stagger the ends thereof and to extend from one tile to the next to interengage said tiles to thereby render said slats immovable relative to each other in a vertical direction relative to the plane of said tiles.

* * * * *